US005325596A

United States Patent [19]

Baker

[11] Patent Number: 5,325,596

[45] Date of Patent: Jul. 5, 1994

[54] SELF DEFENSE GLOVE

[76] Inventor: Joseph L. Baker, 969 Hillsboro Mile, Hillsboro Beach, Fla. 33062

[21] Appl. No.: 72,148

[22] Filed: Jun. 4, 1993

[51] Int. Cl.[5] ..... B26B 27/00

[52] U.S. Cl. ..... 30/298; 30/159; 30/160; 30/304; 2/163

[58] Field of Search ..... 30/298, 152, 154, 158, 30/159, 160, 162, 164, 304, 305, 315, 317, 299; 2/163

[56] References Cited

U.S. PATENT DOCUMENTS

| | | | |
|---|---|---|---|
| 1,315,503 | 9/1919 | Hughes | 30/159 |
| 2,819,521 | 1/1958 | Parker | 30/298 |
| 2,895,139 | 7/1959 | Compton | 2/161 |
| 3,587,591 | 7/1971 | Satterwhite | 128/361 |
| 3,593,803 | 7/1971 | Ibach | 172/370 |
| 3,752,524 | 8/1973 | Reick | 294/25 |
| 3,834,021 | 9/1974 | White et al. | 30/249 |
| 3,981,526 | 9/1976 | Lundqvist | 30/298 |
| 4,096,629 | 6/1978 | Levine | 30/152 |
| 4,976,032 | 12/1990 | Battaglia | 30/298 |
| 5,058,278 | 10/1991 | Colvin | 30/298 |

*Primary Examiner*—Eugenia Jones
*Assistant Examiner*—Allan M. Schrock
*Attorney, Agent, or Firm*—Malin, Haley, DiMaggio & Crosby

[57] ABSTRACT

A self-defense weapon in the form of a glove having retractable blades proximal the fingertips in which the retractable blades are activated by a trigger mechanism remote from the fingertips. The blades are retractable so that the weapon may be safely worn on a wearer's hand while occupying a minimal space and permitting continuation of normal activities. The weapon may be rapidly converted from its reposed condition to its activated position when required.

19 Claims, 8 Drawing Sheets

SELF DEFENSE GLOVE

BACKGROUND OF THE INVENTION

1. Field of the Invention

This invention generally relates to miniaturized bladed weapons that are particularly useful for purposes of self defense by a person against attackers, and more particularly to a glove-type bladed weapon that may be safely carried and stored in a collapsed condition within a small space yet be rapidly activated when needed to repel an attacker.

2. Description of the Prior Art

In the over-populated cities of present day society, people have increasingly become exposed to danger from rapists, muggers, etc., and in many cities, are in constant concern and fear of being alone and unprotected at night, even when indoors.

For self protection of such persons, conventionally available weapons, such as ordinarily available knives and handguns, do not provide a satisfactory solution, since the use of handguns is outlawed in many cities; and even where permitted, requires a certain degree of training and skill in usage that many people do not have and prefer not to acquire. Conventional knives, billy clubs, and other common weapons, on the other hand, are not generally useful devices for people since they are of the wrong shapes, sizes, and configurations to be easily carried in the pocket or purse, as well as often requiring some degree of strength, or skill, or training in their effective uses that many people do not possess; and, like the handguns, do not wish to acquire.

Various manual weapons, such as knives, daggers, swords, rods, darts, and the like have been used for many centuries for self defense. Of these, a knife or a dagger is probably the most suitable weapon for use in close quarters. The knife and dagger may be used both for stabbing and for slashing. Knives and daggers have the disadvantage that they must be grasped tightly during an encounter. If the user's grip should loosen, the knife may slip or may be dropped. Further, knives and daggers have only a single point. If the point misses the target, the opponent may not be stopped and the user is at risk of being injured by a counter-attack from the opponent.

In the past, many non conventional knives and blades have been proposed for different purposes that are carried by and supported by the human hand, arm, or fingers, with many being used for cutting, scraping, or tearing. For example, U.S. Pat. No. 2,895,139 issued Jul. 21, 1959 to Compton discloses a glove having bladed structures attached to the finger areas. U.S. Pat. No. 4,096,629 issued Jun. 27, 1978 to Levine discloses a multi-bladed weapon having means to retract the blades upon the pressing of a button. U.S. Pat. No. 5,058,278 issued Oct. 22, 1991 to Colvin discloses a self-defense weapon which fits over the hand, and has retractable blades. However, no remote actuator is disclosed. U.S. Pat. No. 3,587,591 issued Jun. 28, 1971 to Satterwite discloses a glove having a blade structure which can be slidably controlled by an actuator. None of these devices disclose the cable actuated remote actuating means of the present invention.

There exists a need therefore for a small, portable knife or bladed weapon that can be carried with safety and convenience by the user and that can be rapidly activated when needed to repel an attack and protect the attacked person. Most importantly, there exists a need for such a weapon that can be effectively used by anyone needing a protective weapon, without the need for having any particular degree of skill, degree of strength, or advanced training in order to render the weapon effective for its intended purpose.

SUMMARY OF THE INVENTION

According to the present invention, there is provided a passive, fully-integrated, gloved-based self-defense system. It should be noted that a glove should be worn on each hand of the wearer for ultimate effectiveness. However, it is contemplated that a single glove will provide the wearer with sufficient protection. The glove may have partially open fingertips to accommodate longer nails. The sleeve of the glove will be secured about the wearer's wrist(s) with a wrap around wrist band, such as a Velcro®-type wrist strap, thereby preventing the glove from being pulled off the wearer. A trigger assembly is securely mounted to the glove at the wearer's palm-wrist junction.

The trigger assembly generally comprises a trigger pad; an engagement surface attached to the trigger pad; a dynamic flange member attached to the engagement surface, wherein the flange member moves generally horizontally in a recess in the direction that the trigger pad is pressed; a lanyard block attached to the flange member, wherein a plurality of lanyards are connected to the lanyard block through an aperture in a trigger housing which encloses the flange member and the lanyard block; a safety key removably disposed in a key slot in the trigger housing; a tether anchored at one end to the glove and attached to the safety key at its other end; and a base connected to the trigger housing, wherein the trigger assembly is mounted to the glove by attaching the base to the glove.

A blade assembly is attached to the glove and is carried on a plurality of the wearer's fingers. The blade assembly generally comprises a blade housing having a top wall, a bottom wall, front and rear walls, and side walls, wherein at least one of the walls has an aperture or slot therein. On the inner periphery of the blade housing are guides or rails which permit a sear block or blade safety catch and a blade block to slidably move thereon. The sear block includes a channel or notch in at least one of its walls to facilitate slidable engagement with at least one of the guides. A sear block cocking tine is disposed along the upper periphery of the sear block, wherein the sear block cocking tine travels within one of the slots in the blade assembly housing. A limiter block is disposed within the sear block and is fixedly attached to the blade housing to limit the movement of the sear block. A sear spring is attached to the sear block at one end and to the housing front wall at another end, applying spring pressure, and allowing the blade assembly to be spring loaded for instantaneous deployment as will be described in greater detail hereinafter. A lanyard from the aforementioned trigger assembly is attached to the blade assembly, passing through the sear spring coils, and thus connected to the sear block. The lanyard is circumscribed by a conduit or fluting, which runs along the outer periphery of the glove. The blade block includes a channel or notch in at least one of its walls to facilitate slidable engagement with at least one of the guides. A blade block cocking tine is disposed along the upper periphery of the blade block, wherein the blade block cocking tine travels within another one of the slots in the blade assembly housing; the blade block and the blade block cocking tine moving in a direction generally transverse to the sear block and the sear block cocking tine. A blade block spring is attached to the blade block at one end and to the blade housing top wall at another end, applying spring pressure, thereby allowing the blade assembly to be spring-loaded for instantaneous deployment. A blade is attached to the blade block opposite the blade block spring, and extends through an aperture in the housing's bottom wall when the blade assembly is in an active state. The blade block and the sear block are in an abutting, substantially perpendicular relationship when the blade assembly is in both the passive and the active state, as will be described in greater detail hereinbelow.

The trigger assembly and the blade assembly are connected by the lanyards, thereby providing a cable actuated remote actuating means. The trigger assembly is designed to instantaneously deploy a plurality of sharp blades which are located in the blade assembly or blade enclosures attached to the fingertip areas of the glove.

The following describes the general operation of the self-defense glove of the present invention, with the blade assembly going from the passive (blade retracted) state to the active (blade deployed) state.

In the preferred embodiment, the safety key in the trigger assembly is detented into position in the safety key slot while the self-defense system is in the passive state. When the safety key loop or the tether is pulled, it withdraws the safety key, which then permits the trigger assembly to be deployed only should the wearer deem it necessary to do so. With the safety key withdrawn, the trigger assembly is activated by pushing the trigger pad rearward (i.e. away from the wearer's fingertips and in the direction of the wearer's palm/wrist junction). The dynamic flange member moves rearwardly in conjunction with the trigger pad, into the area previously occupied by the safety key. The lanyard block, which is attached to the flange member, is also moved rearwardly, thereby pulling on the lanyards, which are attached to the lanyard block. As previously mentioned, the trigger assembly and the blade assembly are connected by the lanyards. Pulling on the lanyards causes the sear block to move in the direction of the trigger assembly, compressing the sear spring. The movement of the sear block is limited by the limiter block. When the sear block moves toward the trigger assembly, the blade block, which was in an abutting, substantially perpendicular relationship with the sear block, is "released" and propelled by the blade block spring in a direction transverse to the sear block; the blade block spring being in a compressed state when the blade assembly is in the passive state. The blade then extends through an aperture in the housing's bottom wall, and is positively locked in position by the sear block, wherein the sear block returns to its initial position when the trigger is deactivated by means of the sear block spring, which was compressed when the lanyards pulled the sear block rearwardly. When in its original position, the sear block is once again in a substantially perpendicular, abutting relationship with the blade block. The sear block thus prevents the blade block from moving in a direction away from the blade opening when the blade assembly is in the active state.

In order to return the blade assembly to its passive state, the wearer moves the sear block cocking tine in its slot toward the trigger assembly, compressing the sear block spring, and then, while still holding the sear block cocking tine in place, moves the blade block cocking tine in its slot, compressing the blade block spring and retracting the blade into the housing. The wearer then allows the sear block to return to its initial position by releasing the sear block cocking tine, and then releases the blade block cocking tine, thereby allowing the sear block and the blade block to once again be in an abutting, substantially perpendicular relationship, wherein the sear block prevents the blade block from moving in a direction toward the blade opening when the blade assembly is in the passive state.

Accordingly, it is an object of the invention to provide a new self-defense glove type mechanism having retractable blades at the fingertips.

It is another object of the present invention to provide a self-defense glove requiring little to no skill or training in its effective use.

It is yet another object of the present invention to provide a portable self-defense glove that can be rapidly activated when needed to repel attack.

It is a further object of the present invention to provide a self-defense glove that permits the wearer to engage in normal day to day activities such as typing, driving, etc.

In accordance with these and other objects which will be apparent hereinafter, the instant invention will now become described with particular reference to the accompanying drawings.

BRIEF DESCRIPTION OF THE DRAWINGS

FIG. 3 is a partially cut away isometric view of the trigger assembly with the safety key in.

FIGS. *7a* through *7e* are sectional views illustrating communication between the blade assembly and the trigger assembly as the self-defense system moves from the passive to the active state.

DESCRIPTION OF THE PREFERRED EMBODIMENTS

Figure 1:
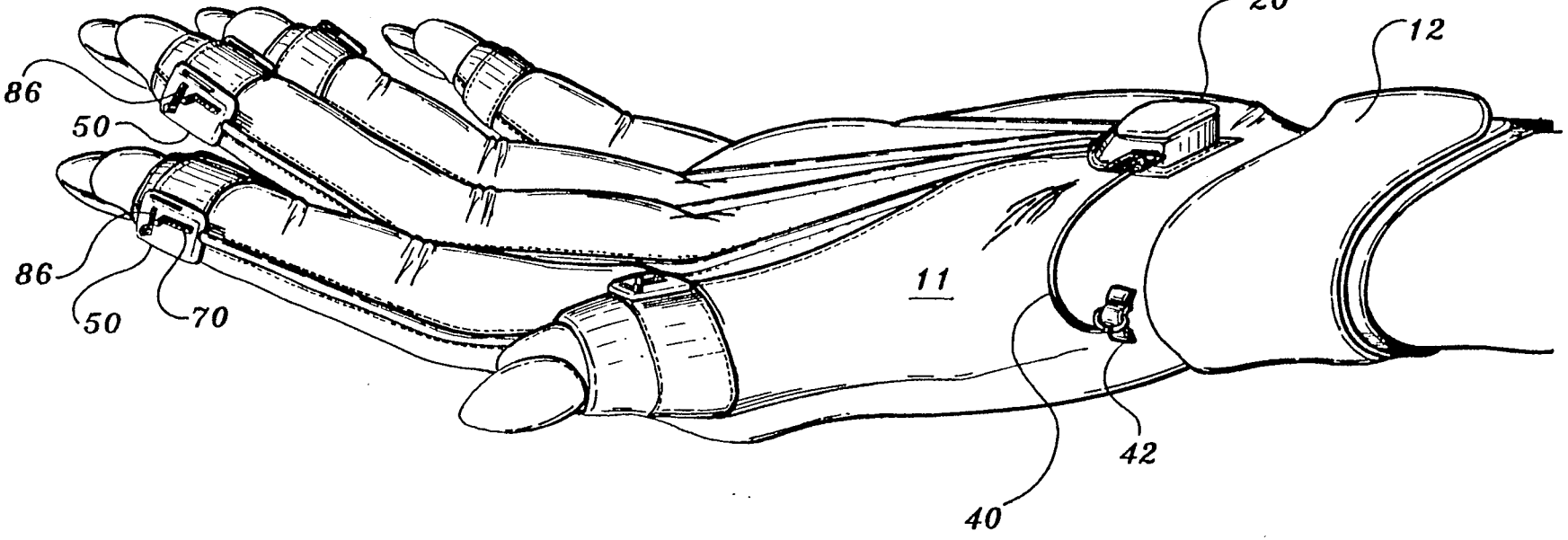
FIG. 1 is a view in perspective showing the self-defense system being worn on the left hand of a wearer in the passive state.
Figure 2:
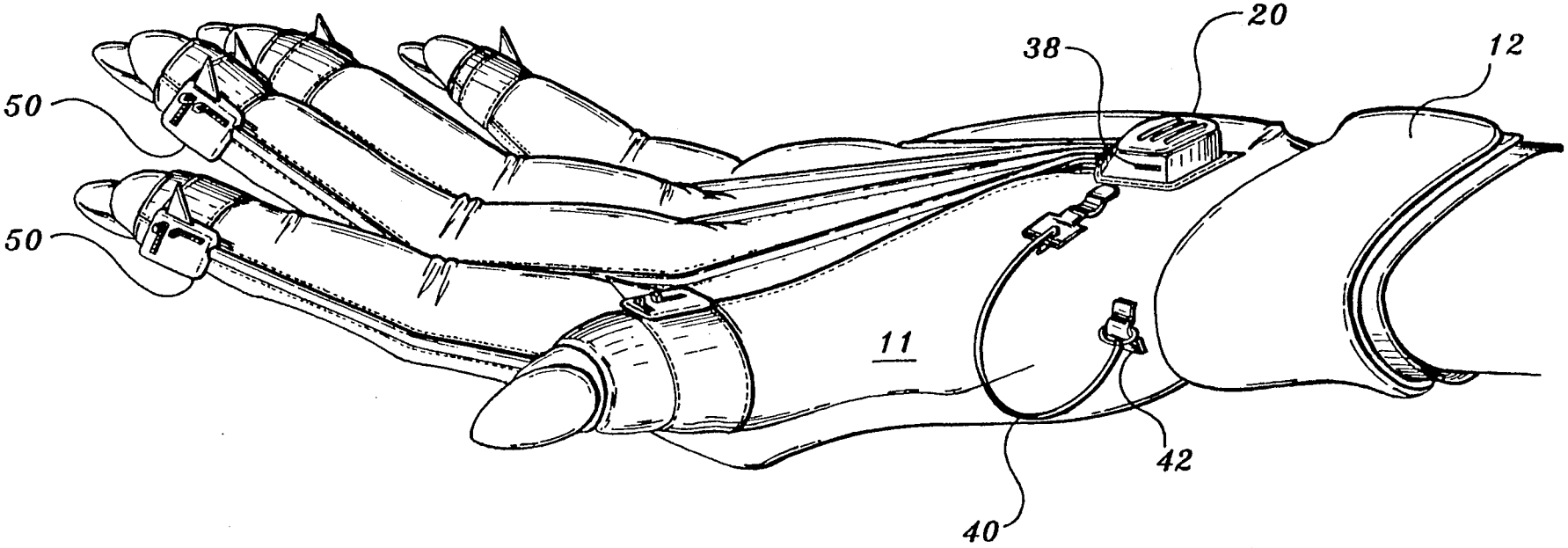
FIG. 2 is a view in perspective showing the self-defense system being worn on the left hand of a wearer in the active state.

Referring generally to the Figures, there is provided a passive, fully integrated, glove-based self-defense system 10. In FIG. 1, the system 10 is shown on the left hand of a wearer in a retracted or stored position, and in FIG. 2, the system 10 is shown in the deployed or active position. The system 10 is generally in the form of a glove 11, shaped to fit over the hand and wrist of a wearer. It should be noted that a glove should be worn on each hand of the wearer for ultimate effectiveness. However, it is contemplated that a single glove will provide the wearer with sufficient protection. In the preferred embodiment, the glove 11 is made of latex or other suitably thin, lightweight, and stretchable material. A releasable wrist strap 12, such as a Velcro® fastener, is located about the user's wrist to retain the glove 11 on the user's hand. As shown in FIGS. 1 and 2, the glove 11 may have partially open fingertips to accommodate longer nails.

Figure 3:
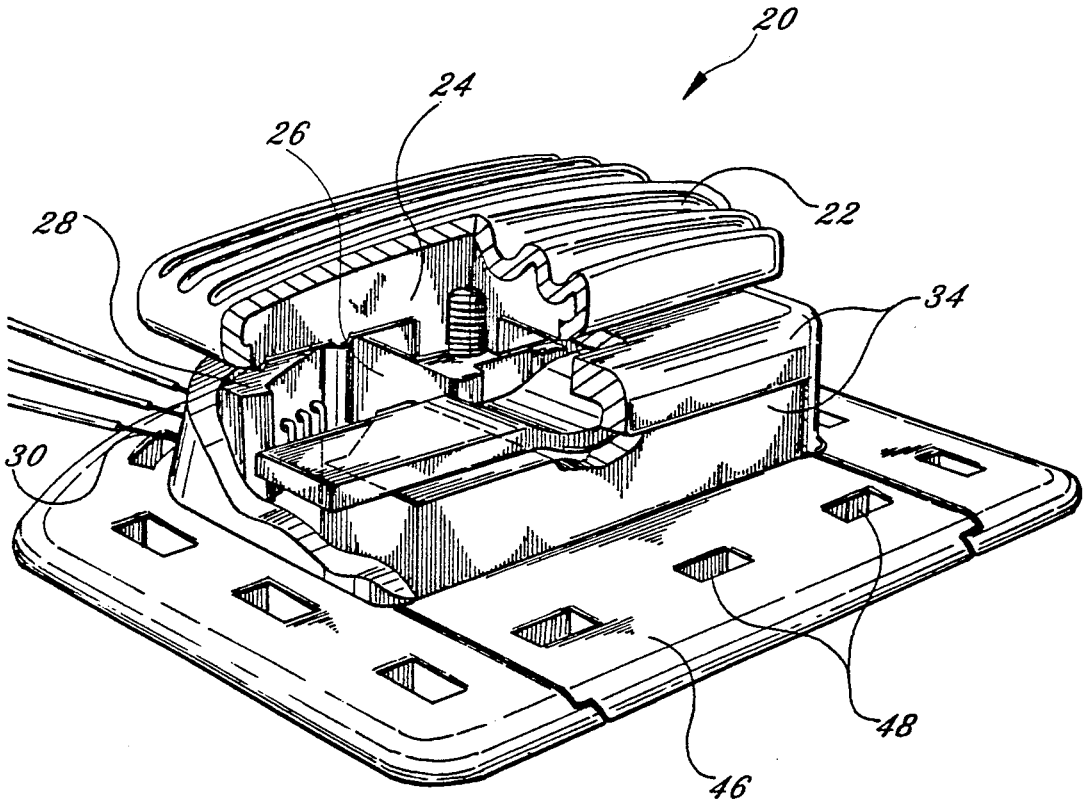
Figure 4:
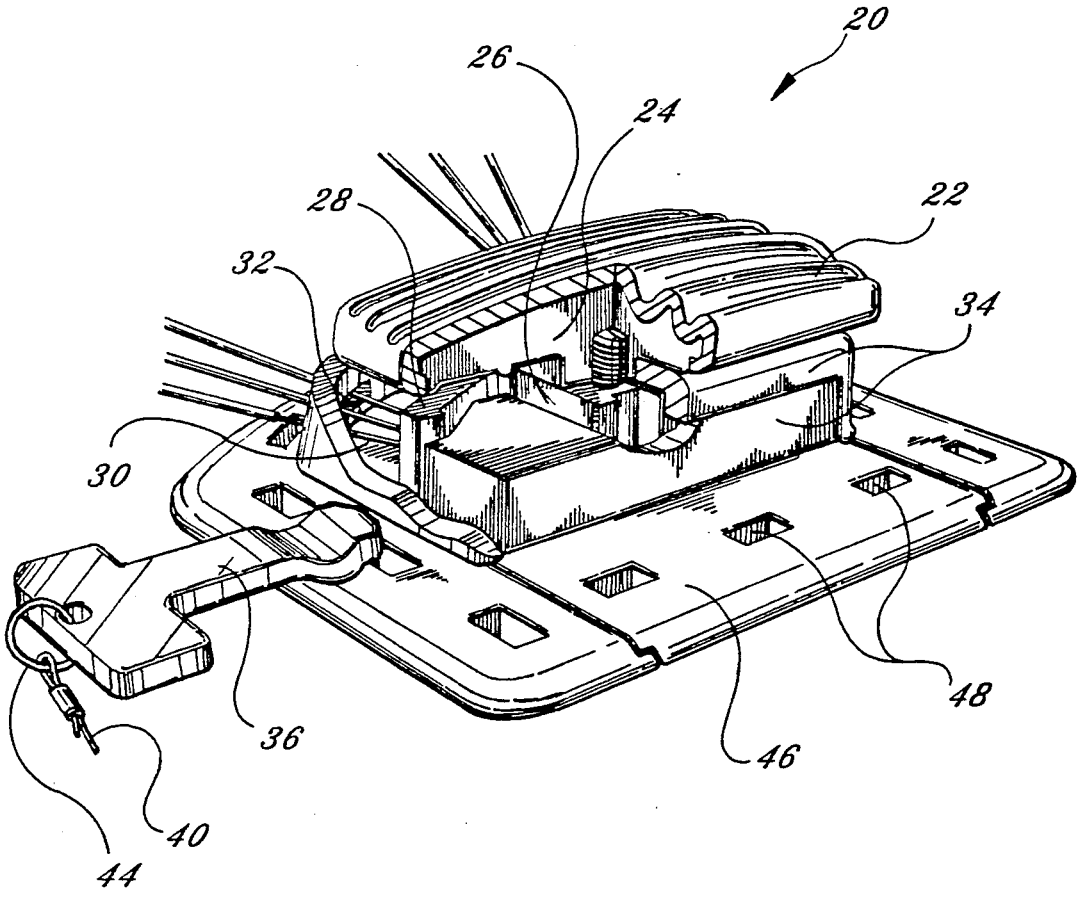
FIG. 4 is a partially cut away isometric view of the trigger assembly with the safety key removed.

As depicted in FIGS. 1 and 2, a trigger assembly 20 is securely mounted to the glove 11 at the wearer's palm/-wrist junction. Referring to FIGS. 3 and 4, the trigger assembly generally comprises a trigger pad 22; an engagement surface 24 attached to the trigger pad 22; a dynamic flange member 26 attached to the engagement surface 24, wherein the flange member 26 moves generally horizontally in a recess 39 in the direction that the trigger pad 22 is pressed; and a lanyard block 28 attached to the flange member 26, wherein a plurality of lanyards 30 are connected to the lanyard block 28 through an aperture 32 in a trigger housing 34, wherein the trigger housing encloses the flange member 26 and the lanyard block 28. The trigger assembly 20 further includes a safety key 36 removably disposed in a key slot 38 in the trigger housing 34; a tether 40 anchored at one end to the glove 11 by a tether anchor 42 (FIG. 2) and attached to the safety key 36 by a safety key ring 44 at its other end; and a base 46 connected to the trigger housing 34, wherein the trigger assembly 20 is mounted to the glove 11 by attaching the base 46 to the glove 11 through base mounting apertures 48.

Figure 5:
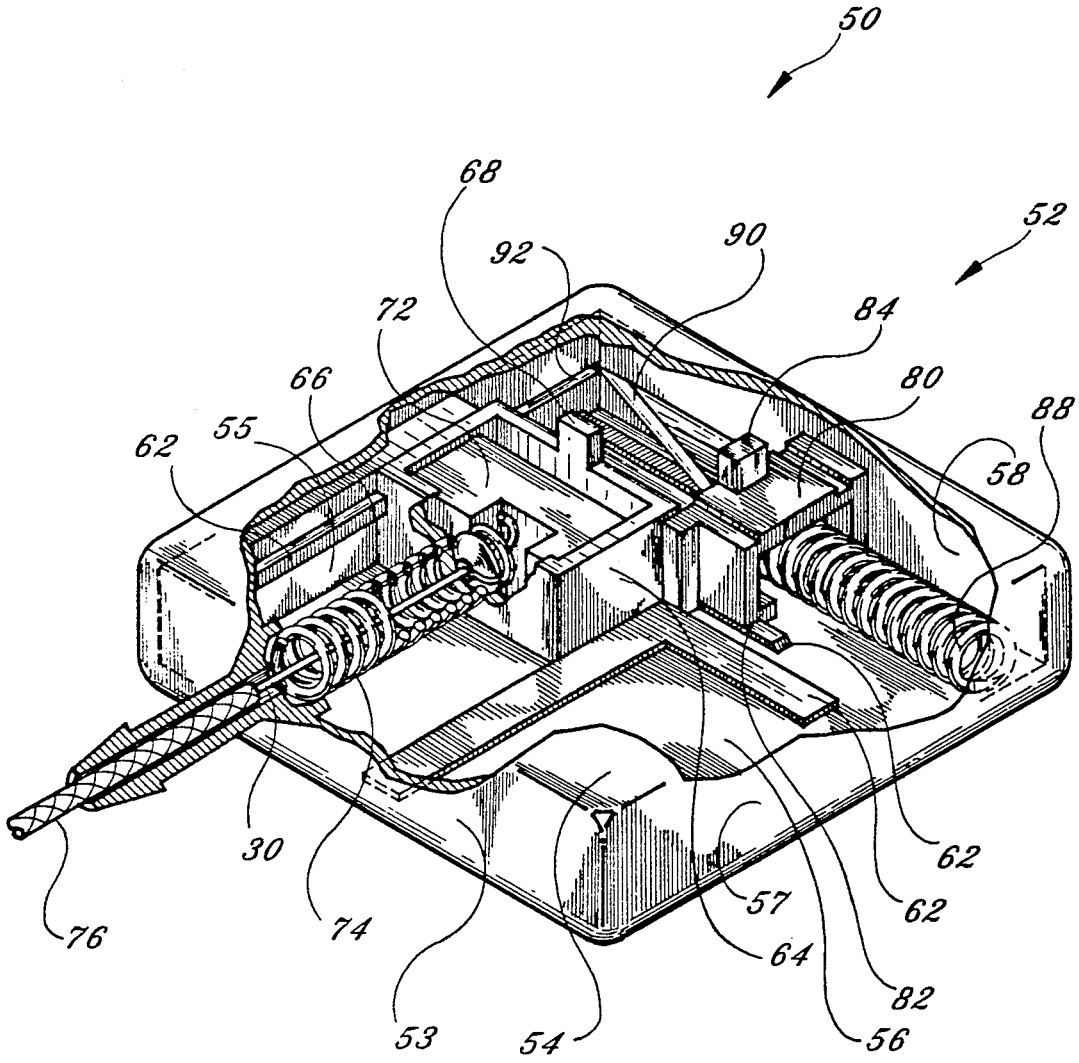
FIG. 5 is a partially cut away view in perspective showing the blade assembly in the passive state.
Figure 6:
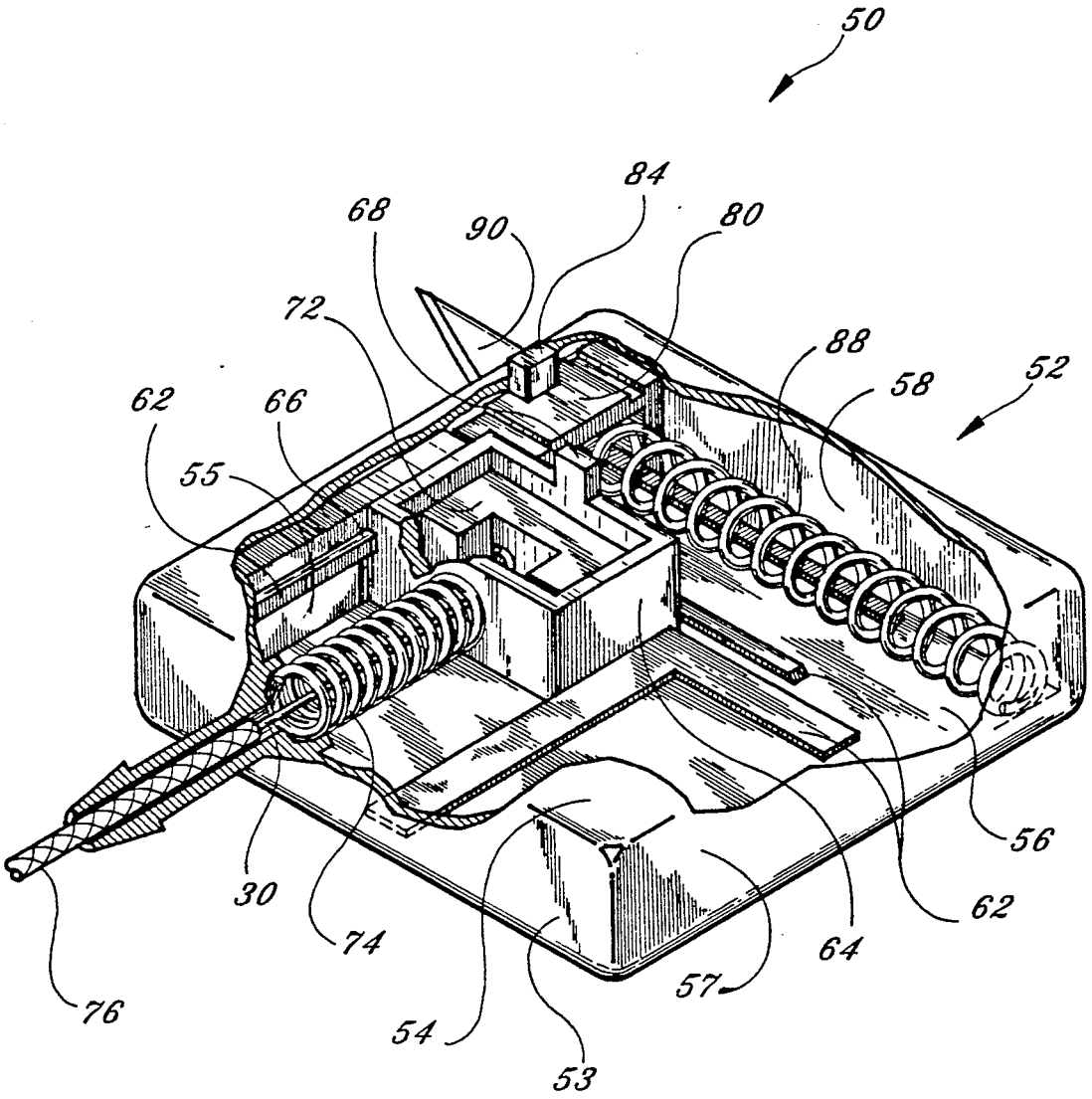
FIG. 6 is a partially cut away view in perspective showing the blade assembly in the active state.
Figure 7A:
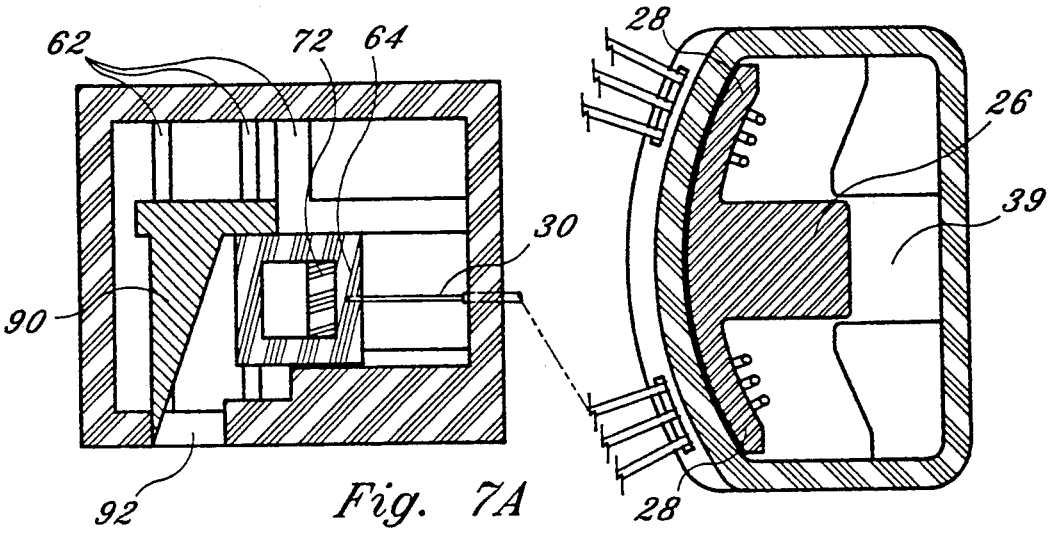
Figure 7B:
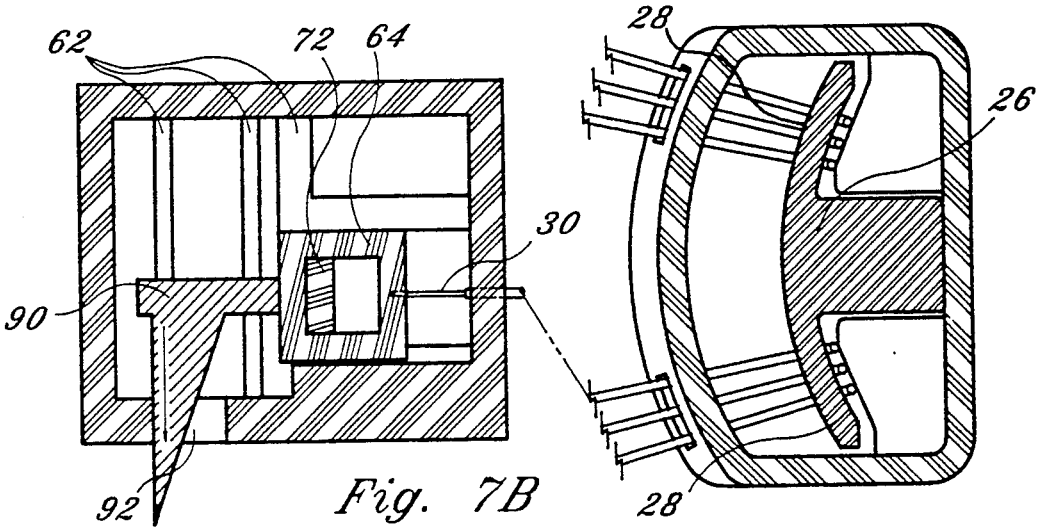
Figure 7C:
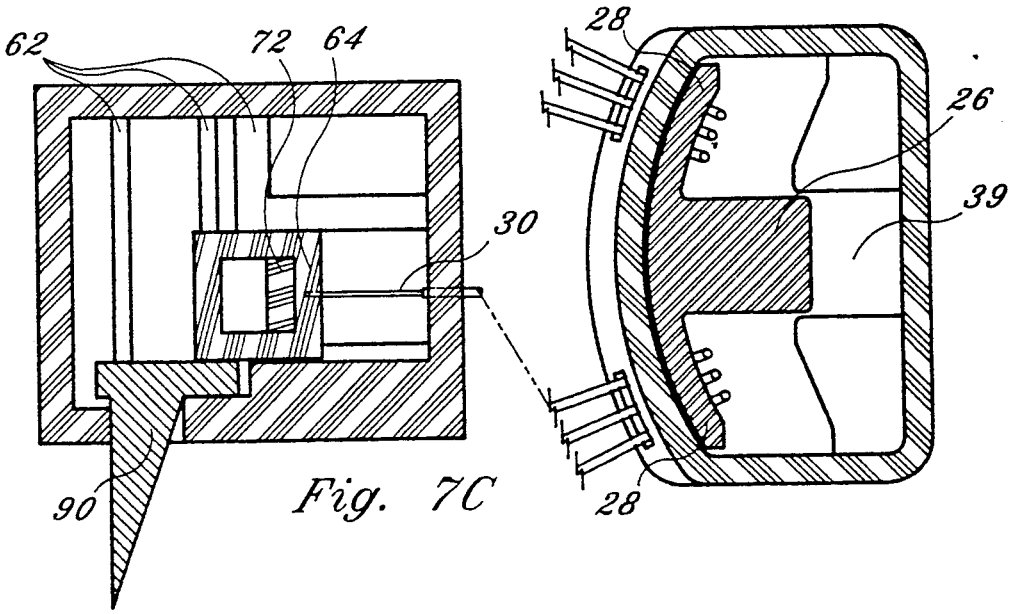
Figure 7D:
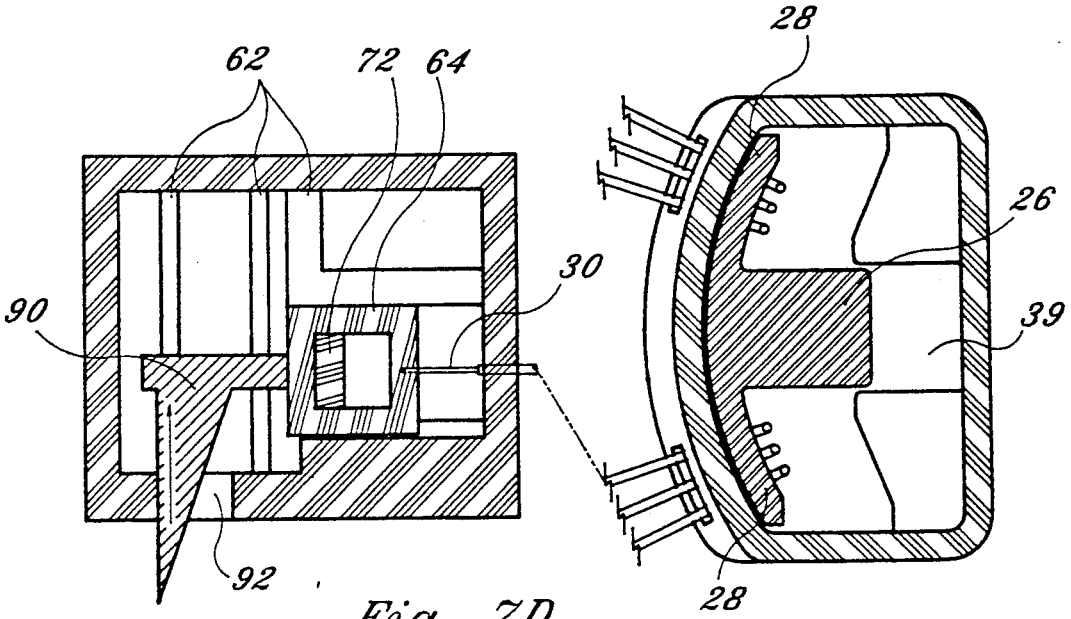
Figure 7E:
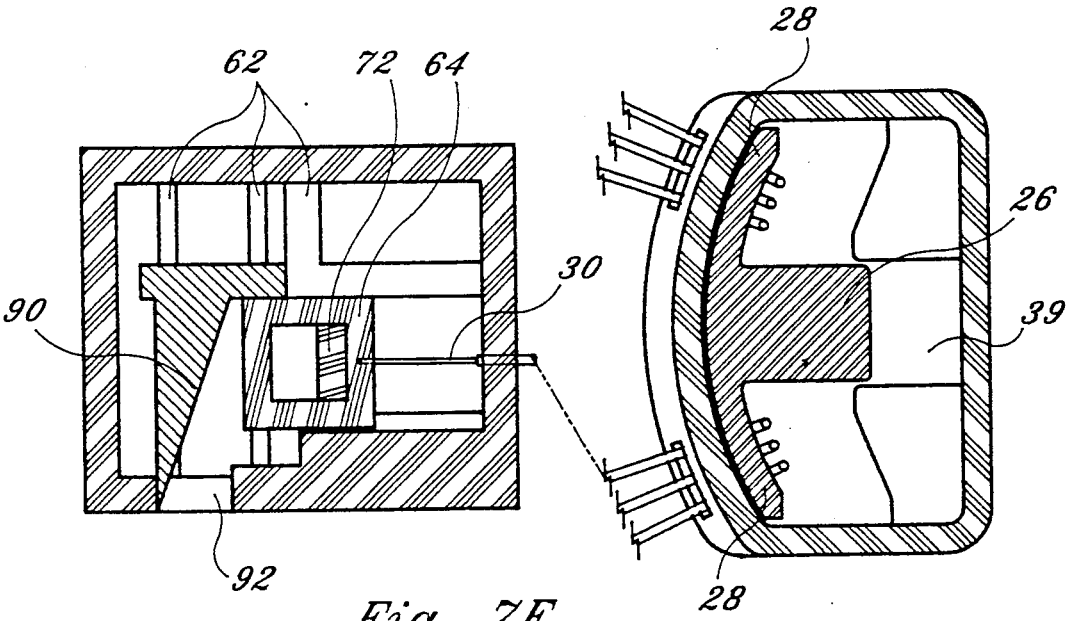

Referring again to FIGS. 1 and 2, a blade assembly 50 is shown attached to the glove 11, and is carried on a plurality of the wearer's fingers. As seen in FIGS. 1 and 2, the blade assembly 50 is attached to each of the wearer's fingers. However, this is by way of illustration only as it is intended that a glove with blade assemblies attached to less than all the wearer's fingers would still fall within the scope of the present invention. Referring to FIGS. 5, 6, and *7a* through *7e*, the blade assembly 50 generally comprises a blade housing 52 having a top wall 57, a bottom wall 55, front and rear walls 53 and 58 respectively and side walls 54 and 56, respectively, wherein at least one of the bottom wall 55 and the side walls 54, 56 has at least one aperture or slot therein (as best seen in FIG. 1). On the inner periphery of the blade housing 52 are guides or rails 62 which permit a sear block 64 or blade safety catch and a blade block 80 to slidably move thereon. Referring to FIGS. 5 and 6, the sear block 64 includes a channel or notch 82 in at least one of its walls for slidable engagement with at least one of the guides 62. A sear block cocking tine 68 is disposed along the upper periphery of the sear block 64, wherein the sear block cocking tine 68 travels within a sear block cocking tine slot 70 (FIG. 1) in the blade assembly housing side wall 54. A limiter block 72 is disposed within the sear block 64 and is fixedly attached to the blade housing side wall 56 to limit the movement of the sear block 64. As seen in FIGS. *7a* through *7e*, the limiter block 72 is smaller in size than the sear block 64, such that a gap exists between the sear block 64 and the limiter block 72, the limiter block 72 thereby limiting the movement of the sear block 64. Referring again to FIGS. 5, 6, and *7a* through *7e*, a sear spring 74 is attached to the sear block 64 at one end and to the housing front wall 53 at another end, applying spring pressure, and allowing the blade assembly 50 to be spring-loaded for instantaneous deployment. A lanyard 30 from the aforementioned trigger assembly 20 is attached to blade assembly 50 and passes through the sear spring coils 74 and is connected to the sear block 64. The lanyard 30 is circumscribed by a conduit or fluting 76, which runs along the outer periphery of the glove 11. The blade block 80 includes a channel or notch 82 in at least one of its walls for slidable engagement with at least one of the guides 62. A blade block cocking tine 84 is disposed along the upper periphery of the blade block 80, wherein the blade block cocking tine 84 travels within a blade block cocking tine slot 86 (FIG. 1) in the blade assembly housing side wall 54. The blade block 80 and the blade block cocking tine 84 move in a direction generally transverse to the sear block 64 and the sear block cocking tine 68. A blade block spring 88 is attached to the blade block 80 at one end and to the blade housing top wall 57 at another end, applying spring pressure, thereby allowing the blade assembly 50 to be spring-loaded for instantaneous deployment. A blade 90 is attached to the blade block 80 opposite the blade block spring 88, and extends through a blade aperture 92 in the blade assembly housing's bottom wall 55 when the blade assembly 50 is in an active state. The blade block 80 and the sear block 64 are in an abutting, substantially perpendicular relationship when the blade assembly is in both the passive and the active state.

As seen in FIGS. 1, 2, and *7a* through *7e*, the trigger assembly 20 and the blade assembly 50 are connected by the lanyards 30, thereby providing a cable-actuated remote actuating means. The trigger assembly 20 is designed to instantaneously deploy a plurality of sharp blades 90 which are located in the blade assembly 50 attached to the fingertip areas of the glove 11. The general operation of the self-defense system 10 of the present invention, with the blade assembly 50 going from the retracted, passive state to the deployed, active site is as follows.

In the preferred embodiment, the safety key 36 in the trigger assembly 20 is detected into position in the safety key slot 38 while the self defense system is in the passive state. When the safety key 36 is removed from the safety key slot 38, either by pulling on safety key loop 44, tether 40, or the safety key 36 itself, it withdraws the safety key 36, permitting the trigger assembly 20 to be deployed only should the wearer deem it necessary to do so. With the safety key 36 withdrawn, the trigger assembly 20 is activated by pushing the trigger pad 22 in the direction of the wearer's palm/wrist junction. The dynamic flange member 26 moves rearwardly in conjunction with the trigger pad 22 into the area previously occupied by the safety key 36. The lanyard block 28, which is attached to the flange member 26, is also moved rearwardly, thereby pulling on the lanyards 30, which are attached to the lanyard block 28. Pulling on the lanyards 30 causes the sear block 64 to move in the direction of the rigger assembly 20, compressing sear spring 74. Movement of sear block 64 is limited by limiter block 72. When the sear block 64 moves toward the trigger assembly 20, the blade block 80, which was in an abutting, substantially perpendicular relationship with the sear block 64, is "released" and propelled by the blade block spring 88 in a direction transverse to the sear block 64. It should be noted that the blade block spring 88 is in a compressed state when the blade assembly 50 is in the passive state. The blade 90 then extends through blade aperture 92 in the blade assembly housing's bottom wall 55, and is positively locked in position by the sear block 64, wherein the sear block 64 returns to its initial position when the trigger pad 22 is released. This occurs because sear block spring 74, which was compressed when the lanyards 30 pulled the sear block 64 in the direction of trigger assembly 20, is released when trigger pad 22 is released. Sear block 64 thus prevents blade block 80 from moving in a direction away from blade opening 92 by being in a substantially perpendicular, abutting relationship with blade block 80.

As best seen in FIGS. 2, 6, and 7*a* through 7*e*, in order to return the blade assembly 50 to its passive state, the wearer moves sear block cocking tine 68 in its slot 70 toward trigger assembly 20, compressing sear block spring 74, and then, while still holding the sear block cocking tine 68 in place, moves the blade block cocking tine 84 in its slot 86, compressing the black block spring 88 and retracting the blade 90 into the blade assembly housing 52. The wearer then allows sear block 64 to return to its initial position by releasing sear block cocking tine 68, decompressing sear block spring 74, and then releases blade block cocking tine 84, thereby allowing the sear bock 64 and the blade block 80 to once again be in abutting, substantially perpendicular relationship, wherein sear block 64 prevents blade block 80 from moving in a direction toward blade opening 92.

The instant invention has been shown and described herein in what is considered to be the most practical and preferred embodiment. It is recognized, however, that departures may be made therefrom within the scope of the invention and that obviously modifications will occur to a person skilled in the art.

What is claimed is:

1. A self-defense weapon, comprising:

a glove having a back portion, a palm portion, finger members, and a sleeve, said glove to be worn on a hand of a wearer;

a retractable blade, means for housing said retractable blade, said means for housing attached to one of a plurality of said finger members proximal the wearer's fingertips; and means for actuating said blade, said means for actuating attached to said glove, said means for actuating disposed remote from, said blade housing and a lanyard connecting said actuating means to said housing means.

2. The self-defense weapon of claim 1, wherein said means for actuating is a trigger assembly.

3. The self-defense weapon of claim 2, wherein said trigger assembly is attached to said glove proximal the wearer's wrist.

4. The self-defense weapon of claim 2, wherein said trigger assembly comprises:

a trigger pad;

an engagement surface attached to said trigger pad;

a dynamic flange member attached to the engagement surface, wherein said flange member moves generally horizontally in a slot in conjunction with said trigger pad in the direction that said trigger pad is pressed;

a lanyard block attached to said flange member, wherein a plurality of lanyards are connected to said lanyard block, said lanyards extending through an aperture in a trigger housing, said trigger housing enclosing said flange member and said lanyard block;

a safety key removably disposed in a key slot in said trigger housing;

a tether anchored at one end to the glove and attached to said safety key at its other end; and a base connected to said trigger housing, wherein said trigger assembly is mounted to the glove by attaching the base to the glove.

5. The self-defense weapon of claim 1, wherein said means for housing said retractable blade is a blade assembly.

6. The self-defense weapon of claim 5, wherein said blade assembly comprises:

a blade housing having a top wall, a bottom wall, a front wall, a rear well, and side walls, wherein at least one of the bottom wall and side walls has a slot therein;

guide rails disposed along the inner periphery of said blade housing;

a sear block, said sear block being slidably engageable with at least one of said guide rails, said sear block having a lanyard attached thereto, wherein said lanyard connects said blade assembly to said means for actuating;

a limiter block disposed within said sear block, said limiter block fixedly attached to one of the side walls of said blade housing, said limiter block perimeter being smaller than said sear block perimeter, such that a gap exists between said sear block and said limiter block, said limiter block thereby limiting the movement of said sear block; and a blade block, said blade block being slidably engageable with at least one of said guide rails, said blade block having said blade attached thereto, said blade block and said sear block being in an abutting, substantially perpendicular relationship when said blade assembly is in either a passive state or an active state.

7. The self-defense weapon of claim 6, wherein said blade assemblies further includes:

a sear block spring attached to said sear block at one end and to the blade housing front wall at another end; and a blade block spring attached to said blade block at one end and to the blade housing top wall at another end, said sear block spring and said blade block spring allowing said blade assembly to be spring-loaded for instantaneous deployment of said blade through a blade aperture in said blade housing bottom wall.

8. The self-defense weapon of claim 6, wherein said sear block includes a sear block cocking tine disposed along an upper periphery of said sear block, said sear block cocking tine extending through a first slot in a first one of said blade housing side walls.

9. The self-defense weapon of claim 8, wherein said blade block includes a blade block cocking tine disposed along an upper periphery of said blade block, said blade block cocking tine extending through a second slot in said first blade housing side wall.

10. The self-defense weapon of claim 1, including an adjustable wrist-engaging band affixed to the sleeve of said glove to snugly and comfortably engage the wearer's wrist.

11. A self-defense weapon, comprising:

a glove having a back portion, a palm portion, finger members, and a sleeve, said glove to be worn on a hand of a wearer:

a plurality of blade assemblies each having a retractable blade, said blade assemblies each attached to one of a plurality of said finger members proximal to wearer's fingertips; and a trigger assembly, said trigger assembly connected to said blade assemblies by a plurality of lanyards, said trigger assembly attached to said glove remote from said blade assembly, said trigger assembly including means for actuating said blades.

12. The self-defense weapon of claim 11, wherein said trigger assembly is attached to said glove proximal the wearer's wrist.

13. The self-defense weapon of claim 11, wherein said trigger assembly includes:

a trigger pad;

an engagement surface attached to said trigger pad;

a dynamic flange member attached to the engagement surface, wherein said flange member moves generally horizontally in a slot in conjunction with said trigger pad in the direction that said trigger pad is pressed;

a lanyard block attached to said flange member, wherein a plurality of lanyards are connected to said lanyard block, said lanyards extending through an aperture in a trigger housing, said trigger housing enclosing said flange member and said lanyard block;

a safety key removably disposed in a key slot in said trigger housing;

a tether anchored at one end to the glove and attached to said safety key at its other end; and a base connected to said trigger housing, wherein said trigger assembly is mounted to the glove by attaching the base to the glove.

14. The self-defense weapon of claim 11, wherein each of said blade assemblies comprises:

a blade housing having a top wall, a bottom wall, a front wall, a rear well, and side walls, wherein at least one of the bottom wall and side walls has a slot therein;

guide rails disposed along the inner periphery of said blade housing;

a sear block, said sear block being slidably engageable with at least one of said guide rails, said sear block having a lanyard attached thereto, wherein said lanyard connects said blade assembly to said means for actuating;

a limiter block disposed within said sear block, said limiter block fixedly attached to one of the side walls of said blade housing, said limiter block perimeter being smaller than said sear block perimeter, such that a gap exists between said sear block and said limiter block, said limiter block thereby limiting the movement of said sear block; and a blade block, said blade block being slidably engageable with at least one of said guide rails, said blade block having said blade attached thereto, said blade block and said sear block being in an abutting, substantially perpendicular relationship When said blade assembly is in either a passive state or an active state.

15. The self-defense weapon of claim 14, wherein each of said blade assemblies further includes:

a sear block spring attached to said sear block at one end and to the blade housing front wall at another end; and a blade block spring attached to said blade block at one end and to the blade housing top wall at another end, said sear block spring and said blade block spring allowing said blade assembly to be spring-loaded for instantaneous deployment of said blade through a blade aperture in said blade housing bottom wall.

16. The self-defense weapon of claim 14, wherein said sear block includes a sear block cocking tine disposed along an upper periphery of said sear block, said sear block cocking tine extending through a first slot in a first one of said blade housing side walls.

17. The self-defense weapon of claim 16, wherein said blade block includes a blade block cocking tine disposed along an upper periphery of said blade block, said blade block cocking tine extending through a second slot in said first blade housing side wall.

18. The self-defense weapon of claim 11, including an adjustable wrist-engaging band affixed to the sleeve to snugly and comfortably engage the wearer's wrist.

19. A self-defense weapon, comprising:

a glove having a back portion, a palm portion, finger members, and a sleeve, said glove to be worn on a hand of a wearer:

a blade assembly having a retractable blade, said blade assembly attached to a plurality of said finger members proximal to wearer's fingertips, said blade assembly comprising:

a blade housing having a top wall, a bottom wall, a front wall, a rear wall, and side walls, wherein at least one of the bottom wall and side walls has a slot therein;

guide rails disposed along the inner periphery of said blade housing;

a sear block, said sear block being slidably engageable with at least one of said guide rails, said sear block having a lanyard attached thereto, wherein said lanyard connects said blade assembly to a trigger assembly;

a limiter block disposed within said sear block, said limiter block fixedly attached to one of the side walls of said blade housing, said limiter block perimeter being smaller than said sear block perimeter, such that a gap exists between said sear block and said limiter block, said limiter block thereby limiting the movement of said sear block;

a blade block, said blade block being slidably engageable with at least one of said guide rails, said blade block having said blade attached thereto, said blade block and said sear block being in an abutting, substantially perpendicular relationship when said blade assembly is in either a passive state or an active state;

a sear block spring attached to said sear block at one end and to the blade housing front wall at another end;

a blade block spring attached to said blade block at one end and to the blade housing top wall at another end, said sear block spring and said blade block spring allowing said blade assembly to be spring-loaded for instantaneous deployment of said blade through a blade aperture in said blade housing bottom wall;

a sear block cocking tine disposed along an upper periphery of said sear block, said sear block cocking tine extending through a first slot in a first one of said blade housing side walls; and a blade block cocking tine disposed along an upper periphery of said blade block, said blade block cocking tine extending through a second slot in said first blade housing sidewall;

said trigger assembly attached to said glove proximal the wearer's wrist, said trigger assembly comprising:

a trigger pad;

an engagement surface attached to said trigger pad;

a dynamic flange member attached to the engagement surface, wherein said flange member moves generally horizontally in a slot in conjunction with said trigger pad in the direction that said trigger pad is pressed;

a lanyard block attached to said flange member, wherein a plurality of lanyards are connected to said lanyard block, said lanyards extending through an aperture in a trigger housing, said trigger housing enclosing said flange member and said lanyard block;

a safety key removably disposed in a key slot in said trigger housing;

a tether anchored at one end to the glove and attached to said safety key at its other end; and a base connected to said trigger housing, wherein said trigger assembly is mounted to the glove by attaching the base to the glove; and an adjustable wrist-engaging band affixed to the sleeve of said glove to snugly and comfortably engage the wearer's wrist.

* * * * *

UNITED STATES PATENT AND TRADEMARK OFFICE

CERTIFICATE OF CORRECTION

PATENT NO. : 5,325,596

DATED : July 5, 1994

INVENTOR(S) : Joseph L. Baker

It is certified that error appears in the above-identified patent and that said Letters Patent is hereby corrected as shown below:

Column 6, line 32, delete "detected and substitute therefor --detented--.

Column 6, line 49, delete "rigger" and substitute therefor --trigger--.

Column 7, line 9, delete "black" and substitute therefor --blade--.

Column 7, line 38, after "from" delete ",".

Column 7, line 38, after "housing" insert --,--.

Column 8, line 65, after "to" insert --the--.

Signed and Sealed this

Twenty-seventh Day of December, 1994

*Attest:*

Bruce Lehman

BRUCE LEHMAN

*Attesting Officer*

*Commissioner of Patents and Trademarks*